US009486826B2

(12) United States Patent
Taberlet et al.

(10) Patent No.: US 9,486,826 B2
(45) Date of Patent: Nov. 8, 2016

(54) DEVICE FOR PACKAGING AND DISPENSING FLUID PRODUCTS, HAVING A MANUAL PUMP

(71) Applicant: LABLABO, Juvigny (FR)

(72) Inventors: Jean-Philippe Taberlet, Villard (FR); Patrice Puviland, La Roche sur Foron (FR); Alain Guy, Marigniers (FR)

(73) Assignee: LABLABO, Juvigny (FR)

( * ) Notice: Subject to any disclaimer, the term of this patent is extended or adjusted under 35 U.S.C. 154(b) by 47 days.

(21) Appl. No.: 14/395,967

(22) PCT Filed: Apr. 23, 2013

(86) PCT No.: PCT/FR2013/050902

§ 371 (c)(1),
(2) Date: Oct. 21, 2014

(87) PCT Pub. No.: WO2013/160608

PCT Pub. Date: Oct. 31, 2013

(65) Prior Publication Data

US 2015/0102064 A1 Apr. 16, 2015

(30) Foreign Application Priority Data

Apr. 24, 2012 (FR) ..... 12 53727

(51) Int. Cl.
*B67B 1/00* (2006.01)
*B05B 11/00* (2006.01)

(52) U.S. Cl.
CPC ..... *B05B 11/3054* (2013.01); *B05B 11/0027* (2013.01); *B05B 11/3047* (2013.01); *B05B 11/0043* (2013.01); *B05B 11/3059* (2013.01)

(58) Field of Classification Search
CPC ..... B05B 11/3054; B05B 11/0027; B05B 11/0043; B05B 11/3059; B05B 11/3047; B05B 11/306; B65D 2101/007; B65D 2101/0023; B65D 41/3447; B65D 55/024; B65D 55/089; B65D 83/226; B65D 83/224; A61J 1/00
USPC ..... 222/153.05, 153.06, 153.07, 513.11, 222/153.14, 320–321.9, 383.1–385; 215/250
See application file for complete search history.

(56) References Cited

U.S. PATENT DOCUMENTS 4,384,660 A * 5/1983 Palmisano ..... B05B 11/3059 222/153.07
5,042,261 A * 8/1991 Yeakel ..... A61B 18/0218 62/293

(Continued)

FOREIGN PATENT DOCUMENTS

JP 2008030838 2/2008
JP 2008030838 A * 2/2008

(Continued)

OTHER PUBLICATIONS

KR200416576—EnglishTranslation, machine generated Jan. 2016.*

(Continued)

*Primary Examiner* — J. Casimer Jacyna
*Assistant Examiner* — Benjamin R Shaw
(74) *Attorney, Agent, or Firm* — Sofer & Haroun, LLP

(57) ABSTRACT

A device is provided for packaging and dispensing fluid products. The device has a manual pump fitted on a bottle or a pouch containing the product to be dispensed, and has a removable element interposed between the pump and the neck of the bottle. An open/close element is secured to the pump and is able to close the passage circuit for the product to be dispensed between the inside of the bottle and the pump when the removable element is in place.

10 Claims, 4 Drawing Sheets

(56) References Cited

U.S. PATENT DOCUMENTS 5,217,433 A * 6/1993 Bunin ..... A61J 1/2093 206/221
5,806,721 A * 9/1998 Tada ..... B05B 11/3001 222/153.13
5,975,370 A * 11/1999 Durliat ..... B05B 11/0027 222/153.06
6,305,581 B1 * 10/2001 Bonningue ..... B05B 11/00 222/207
6,422,425 B1 * 7/2002 Tada ..... B05B 11/3001 222/153.07
7,367,476 B2 * 5/2008 Law ..... B05B 11/0018 222/153.06
8,104,643 B2 * 1/2012 Pruvot ..... B05B 11/3059 222/153.06
8,297,475 B2 * 10/2012 Limbert ..... B05B 11/3087 222/153.07
2003/0006247 A1 * 1/2003 Olivier ..... B65D 47/243 222/83
2007/0023452 A1 * 2/2007 Tseng ..... B05B 11/306 222/153.06
2012/0018456 A1 * 1/2012 Alluigi ..... B05B 11/3025 222/321.8

FOREIGN PATENT DOCUMENTS

KR 200416576 5/2006
KR 200416576 Y1 * 5/2006 ..... B05B 11/0083
WO 2011019217 2/2011

OTHER PUBLICATIONS

JP2008030838—EnglishTranslation, machine generated Jan. 2016.*
International Search Report dated 2014.

* cited by examiner

DEVICE FOR PACKAGING AND DISPENSING FLUID PRODUCTS, HAVING A MANUAL PUMP

RELATED APPLICATIONS

This application is a National Phase Application of PCT/FR2013/050902, filed on Apr. 23, 2013, which in turn claims the benefit of priority from French Patent Application No. 12 53727 filed on Apr. 24, 2012, the entirety of which are incorporated herein by reference.

BACKGROUND

1. Field of the Invention

The present invention relates to an improved device for packaging and dispensing fluid products, and more particularly to a device that ensures perfect preservation of the fluid product contained in the bottle between filling and first use.

2. Description of Related Art

It is known that keeping fluid products contained in dispensing devices protected from their outside environment is an important condition for the preservation of their composition, their characteristics and consequently their activity, in particular for pharmaceutical and cosmetic products. While the period of use by the patient is generally quite short, a few weeks, or even a few days, the storage period for these devices between their filling at the production site and their first use after being put on the market is much longer. Thus, the filled bottles can be stored for a number of months, or even a number of years, under conditions that are not always favorable to good preservation. It is known that direct contact with the outside environment can have very detrimental consequences on the stability of the product contained inside such devices on account, in particular, of the oxidation brought about by the oxygen contained in the air, microbial contamination, or evaporation of active substances or solvents present in the formulation.

In order to avoid this direct contact with the outside environment, numerous devices have been developed which make it possible, during the use phase, to extract the product from the device without air passing into the inside and coming into contact with the product remaining in the device. These devices are generally referred to using the term "airless".

The known devices for packaging and dispensing fluid products generally have a container with a rigid shell in which there moves a piston that pushes the product toward the inlet orifice into the metering chamber and isolates it from the air which passes in below the piston. Also known are devices having a rigid recipient in which there is placed a flexible, deformable pouch that retracts while the product is being extracted therefrom. The product remaining in the pouch is kept protected from the air, while the product can be expelled from the pouch by means of a pump without air intake, or an "airless" pump.

In all cases, provision is made of a vent, generally in the bottom or in the neck of the bottle, to allow outside air to pass into the space located between the bottom of the bottle and the piston or between the bottle and the pouch upon each actuation of the pump and thus to allow the piston to move or the pouch to retract while maintaining sufficient pressure on their walls. One exemplary embodiment using this technique is described in the patent FR 2,723,356, which relates to a device having a pouch made of flexible plastics material, such as polyethylene or polypropylene, in a rigid container, the neck of which has an air inlet.

Another example of a pouch bottle is described in the patent FR 2,827,844, which relates to a device having a sealed flexible pouch which is placed in a rigid bottle and connected to a pump, wherein the pouch comprises a cylindrical wall consisting of a sheet of metal or plastics material wrapped around the edges of two flanges, one of which forms the bottom of the pouch and the other forms a collar for fixing to the bottle and to the pump.

The principle of operation of the metering pumps used in such devices for dispensing fluid, liquid or pasty products is well known. A manual metering pump is generally fitted on a bottle containing the product to be dispensed and consists of a metering chamber having a defined volume, of a piston that is able to move in the chamber under the action of a pusher, and of at least two valves. The lower valve, or inlet valve, which is located at the inlet to the chamber and controls communication with the inside of the bottle, is closed when the pusher is pushed in, while the upper valve, at the outlet from the chamber, is open, allowing through the product expelled from the chamber by the movement of the piston; then, when the pusher is released, the piston is lifted back up in the chamber under the action of a spring, the upper valve closes again, while the lower valve opens, allowing the chamber to be refilled so that a metered quantity of product can be dispensed anew.

The pumps generally associated with flexible pouches have to provide good sealing and to be able to operate in any position, vertical or inclined, of the bottle. The patent FR 2,669,379 describes a metering pump that provides good sealing even in the event of a change of position, of the type having an axial piston bearing a sliding floating piston, having three valves. The patent FR 2,731,992 describes a dispensing bottle in which the pusher is combined with a fixed piston that is integral with the bottle to form a pump. Another example of an airless pump is described in the application WO 04/054721, which relates to a pump for a pouch bottle.

Open/close devices exist to avoid air being introduced into the outlet nozzle of the pump and being able to degrade the product located in this nozzle after each actuation of the pump by the user. For example, the patent FR 2,785,878 describes a dispenser having a manual pump, the nozzle outlet of which is provided with an open/close element that closes automatically when the pump is at rest.

All of these devices afford a satisfactory level of protection during the use phase of the product, the duration of which is generally short.

However, some physicochemical processes contribute to degrading the products contained in the bottles, for example permeation of gases through the materials, evaporation by micro-leaks from the circuit of the pump, or prolonged contact between the product contained and certain complex materials of the device, for example the valves of the pump, but these processes have very slow rates and thus have no influence during the period of use. On the other hand, the long storage period can allow these slow processes to lead to progressive degradation of the products, which then risk being substantially denatured by the time they are used.

It is thus essential to make sure that the products contained in the bottles are perfectly protected from these degradation processes by avoiding as far as possible transfers from the inside of the bottle to the outside and also from the outside to the inside, throughout the storage phase, however long it may be.

These degradation processes can occur through the vent chat is necessary for all "airless" devices since the function of this vent is specifically to allow outside air to come into direct contact with the piston or the pouch, thereby causing a risk of oxidation of the product contained in the device.

They can also occur as a result of micro-leaks, which are inevitable in the circuit of the pump, which has numerous moving parts, and in particular as a result of a lack of sealing at the junction between the pump and the bottle or the pouch, or at the valves of the pump.

This last risk is exacerbated significantly when the contained product remains in contact with the inlet valve of the pump for a long time, as can occur if the device is stored in an inverted vertical or horizontal position. Some ingredients contained in the materials of the valves, which are produced per se from a flexible material, such as from elastomers for example, can migrate into the contained product and modify its composition in a detrimental manner. The reverse can also occur and ingredients contained in the product can migrate into the material of the valves, thereby modifying their dimensional and mechanical properties. These processes can thus, result in a loss of sealing at the valves of the pump and can favor the degradation of the product by contact with the outside environment.

In all of the abovementioned models of dispensing bottles having a manual pump, the product contained in the bottle or pouch is protected from the outside in the same manner, whether the bottle is being stored or being used. However, as indicated above, it is important that good protection be ensured very particularly during the storage of the dispensing device prior to first use.

A number of safeguarding systems have been proposed to protect the contents of a bottle or pouch during storage. Thus, the patent application WO 2001019217 describes a bottle having a manual pump, said bottle being intended to discharge substances that are each contained in a separate container in order that they are not mixed prior to actuation of the pump. To this end, the opening in the containers is closed off by a film while the pump is kept above the film by a lock ring which is taken off prior to first use. A similar device is described in the patents KR 200416576 and JP 2008030838.

OBJECTS AND SUMMARY

The subject of the present invention is specifically a device for packaging and dispensing fluid products, having a manual pump fitted on a bottle containing the product to be dispensed, or enclosing a pouch containing the product, making it possible to reduce transfers between the inside and the outside of the device to a minimum throughout the period between filling and first use.

Another subject of the invention is a safeguarding device for a pump of a dispensing bottle of the above type, said safeguarding device preventing any accidental use of the pump during storage and allowing the end user to be sure that the product has not been used or modified before he uses it himself.

A further subject of the invention is a bottle for dispensing fluid products, comprising such a safeguarded pump.

The expression "fluid product" used in the present application means a product that is not solid at ordinary temperatures and is able to flow out of a container that contains it, such as a liquid, a lotion, an emulsion, a paste, a gel, a product for spraying, etc. These fluid products can be used in various technical fields and can be for example cosmetic products, pharmaceutical products, cleaning products, etc.

The device for packaging and dispensing fluid products according to the invention comprises a pump of the manual pump type for a bottle for dispensing fluid products, said pump being fitted on a bottle containing the product to be dispensed, and it has a removable element interposed between the pump and the neck of the bottle, and an open/close element which is secured to the pump and is able to close the passage circuit for the product to be dispensed between the inside of the bottle and the pump when the removable element is in place.

More specifically, the removable element is placed between the base of the skirt of the pump and the shoulder formed in the neck of the bottle intended to receive the pump, for example by clip-fastening or by interlocking. Thus, this removable element keeps the pump in a raised position with respect to the rigid bottle such that, in this position, the open/close element engages with the neck of the bottle or of the pouch in order to close the passage circuit for the product.

According to one embodiment, the removable element is formed by a double ring with a U-shaped section, the legs of which surround the external and internal faces of the skirt of the pump, and the base of which, connecting the two legs, is frangible. The external ring keeps the edge of the skirt away from its operating position in which it is in contact with the neck of the bottle. Tearing off of the external ring with breakage of the base connecting it to the internal ring releases the pump, which can be brought into its final operating position.

According to another embodiment, the removable element is formed by a single ring surrounding the base of the external face of the skirt of the pump. For first use, tearing off of the ring as above releases the pump, which can then be put into its final operating position.

The open/close element is advantageously fixed to the base of the pump and is in sealed contact with the internal face of the neck of the bottle or of the pouch containing the product, when the removable element is in place on the pump. According to a preferred feature of the invention, the open/close element has at least one annular edge that engages with the internal edge of the support of the pump when the removable element is in place on the pump.

According to another feature, the removable element has a thickness such that, once this element has been taken off, the pump can be depressed on its support in order to be put in its final position and to free up sufficient space between the open/close element, secured to the pump, and the support, for the fluid to pass through.

According to one variant of the invention, the lower face of the open/close element can be covered with a part or a film, for example a metal film that is impermeable to gases, having the effect of making this open/close element impermeable to gases. The part or the metal film, for example a film containing a sheet of aluminum, can be advantageously placed on the lower face of the open/close element or inserted into the thickness of this lower face which is able to come into contact with the product contained in the bottle or the pouch.

The device according to the present invention has the advantage of ensuring good sealing between the inside and the outside of the bottle, or of the pouch as the case may be, such that outside air cannot pass through the vent when it is located in the pump or through the circuit of the pump and reach the product contained in the bottle, or in the pouch, and such that the product itself or ingredients that it contains cannot leak through the pump prior to first actuation of the pusher by the user.

In addition, when the removable element is in place on the pump, the open/close element is in the closed position and it thus forms an isolating wall between the product located in the bottle, or in the pouch, and the pump, thereby making it possible to limit the free volumes above the product and thus to limit any evaporation of the product by pressure balance.

The presence of the removable element in place on the pump shows the user that the device for packaging and dispensing a fluid product has not yet been used and thus constitutes an indicator of the original quality of the product contained therein.

Moreover, when the open/close element is in the closed position, the valves of the pump are completely isolated from the product contained in the bottle or the pouch, thereby avoiding any detrimental interaction between the two throughout the storage period. Since the open/close element is preferably made of the same material as the bottle or the neck of the pouch, this makes it possible to limit the number of materials of different natures that are able to come into contact with the product to be dispensed, throughout the storage period.

The lower face of the open/close element may be sealed, that is to say covered with a film which is preferably made of the same material as the pouch so as to avoid or limit any discontinuity of material in contact with the product contained in the pouch during the storage period prior to first use.

The pump used in the invention may advantageously be what is referred to as an "airless" pump, without air intake, comprising a piston that can move in the metering chamber under the action of a pusher, an inlet valve controlling the passage from the bottle toward the chamber, and an outlet valve being able to close off the chamber.

The pump of the invention thus comprises a conventional pump simply supplemented by two elements, namely the removable element placed on the periphery and the open/close element at the base of the pump.

Implementation can be carried out very easily. The open/close element and the removable element are preassembled on the pump such that during packaging, the pouch (or bottle, as the case may be) is filled with the product, and then the pump is simply put into place just like any other pump, for example by clip-fastening. During first use, the user tears off the removable element, for example by means of a tab, and presses on the pump, or on its pusher, in order to bring it into its final position. This movement has the effect of moving the pump, and consequently the open/close element fixed to the base of the pump, vertically downward, and of freeing up the passage from the bottle to the pump so as to allow the extraction of the product contained in the pouch or in the bottle when the pump is actuated.

If need be, a protective cap can be provided above the pusher of the pump, bearing on the pump or on the collar for attaching to the bottle.

The body of the pump is made in a conventional manner from plastics material such as polypropylene with a density appropriate for providing the desired mechanical qualities. The open/close element can be made of the same material as the collar of the pouch and its lower face can carry a part or a film that is impermeable to gases, for example a sheet combining a number of layers of plastics material such as polyethylene, polypropylene, polyethylene terephthalate (PET), EVOH (ethylene vinyl alcohol copolymer having good gas barrier characteristics), and/or including a sheet of aluminum metal.

The rigid bottle can be produced for example from any appropriate material such as a polyethylene or a polypropylene with a density appropriate to give it the desired mechanical properties. The end of the outlet nozzle of the pump can be provided with a complementary closure system made of any appropriate, flexible and elastic material, and preferably made of nitrile elastomer, butyl elastomer, silicone elastomer or TPE.

The flexible pouch can be manufactured by injection blow molding or extrusion blow molding, for example from low density polyethylene, polypropylene, polyamide, EVOH copolymer, or by welding a multilayer film, or a metal film covered with a plastics film, to a support. The material that forms the pouch can be chosen depending on the nature of the product which it is intended to contain. Thus, a low density polyethylene is generally suitable for products that have low sensitivity to the action of the surrounding air, while a metal film covered with a plastics film is better suited to a product that is susceptible to oxidation.

BRIEF DESCRIPTION OF THE DRAWINGS

An exemplary embodiment of a dispensing bottle having a pump without air intake, or an "airless" pump, in accordance with the present invention is described in the following text with reference to the appended drawings, in which.

DETAILED DESCRIPTION

Figure 1:
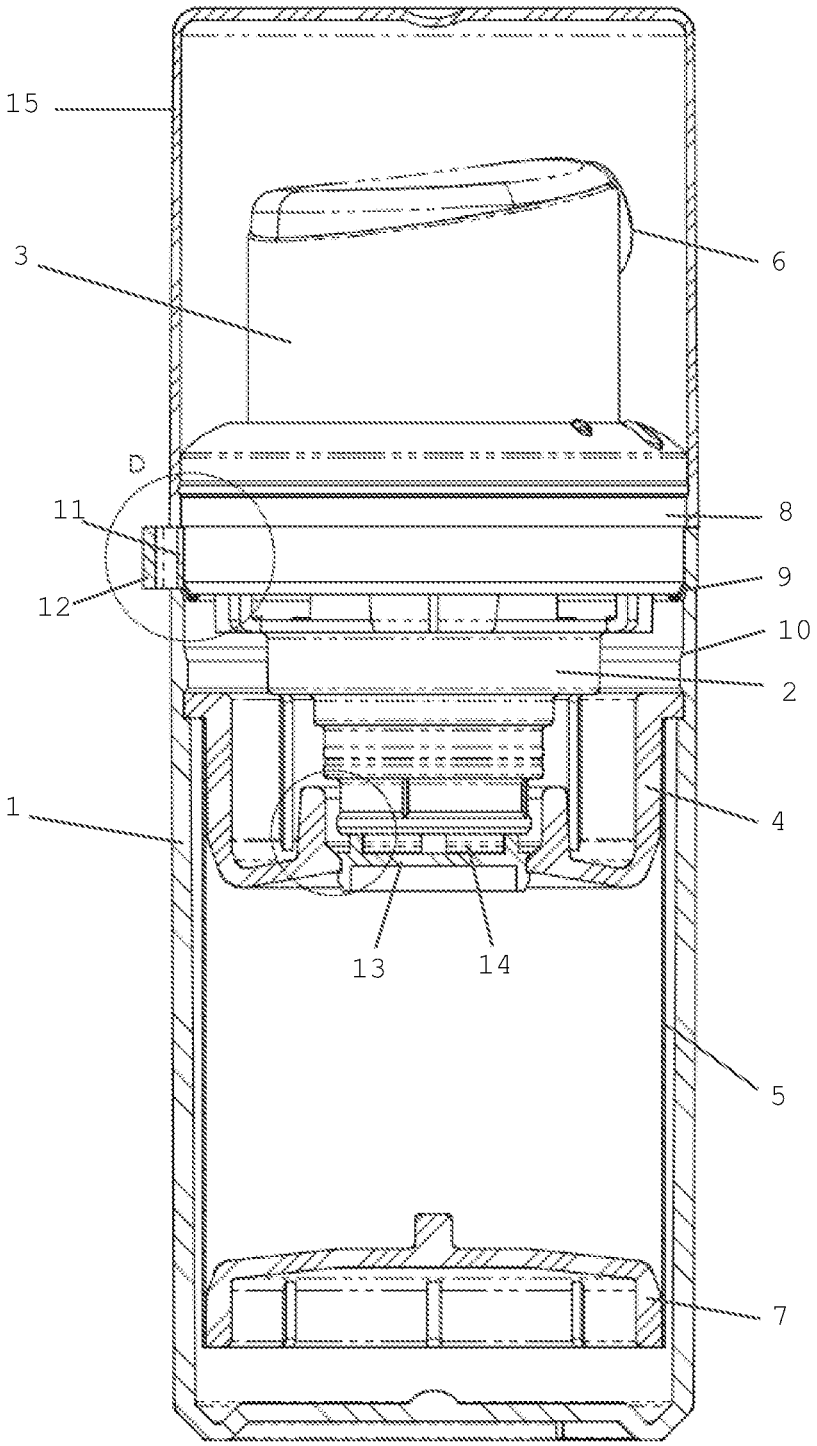
FIG. 1 shows a view in axial section showing a pouch bottle equipped with the device of the invention.

FIG. 1 shows a rigid bottle (1) carrying a pump (2) without air intake which is actuated by a pusher (3), fitted on a collar (4) snap-fastened into the neck of the rigid bottle (1) and secured to the neck of the pouch having a flexible and deformable wall (5) containing the product to be dispensed.

The pump (2) is connected in a conventional manner to the outlet nozzle (6) provided in the pusher (3) so as to extract the product contained in the pouch (5). The pouch is closed off in its bottom part by the cup (7) fixed in a sealed manner to the flexible wall (5).

Figure 6:
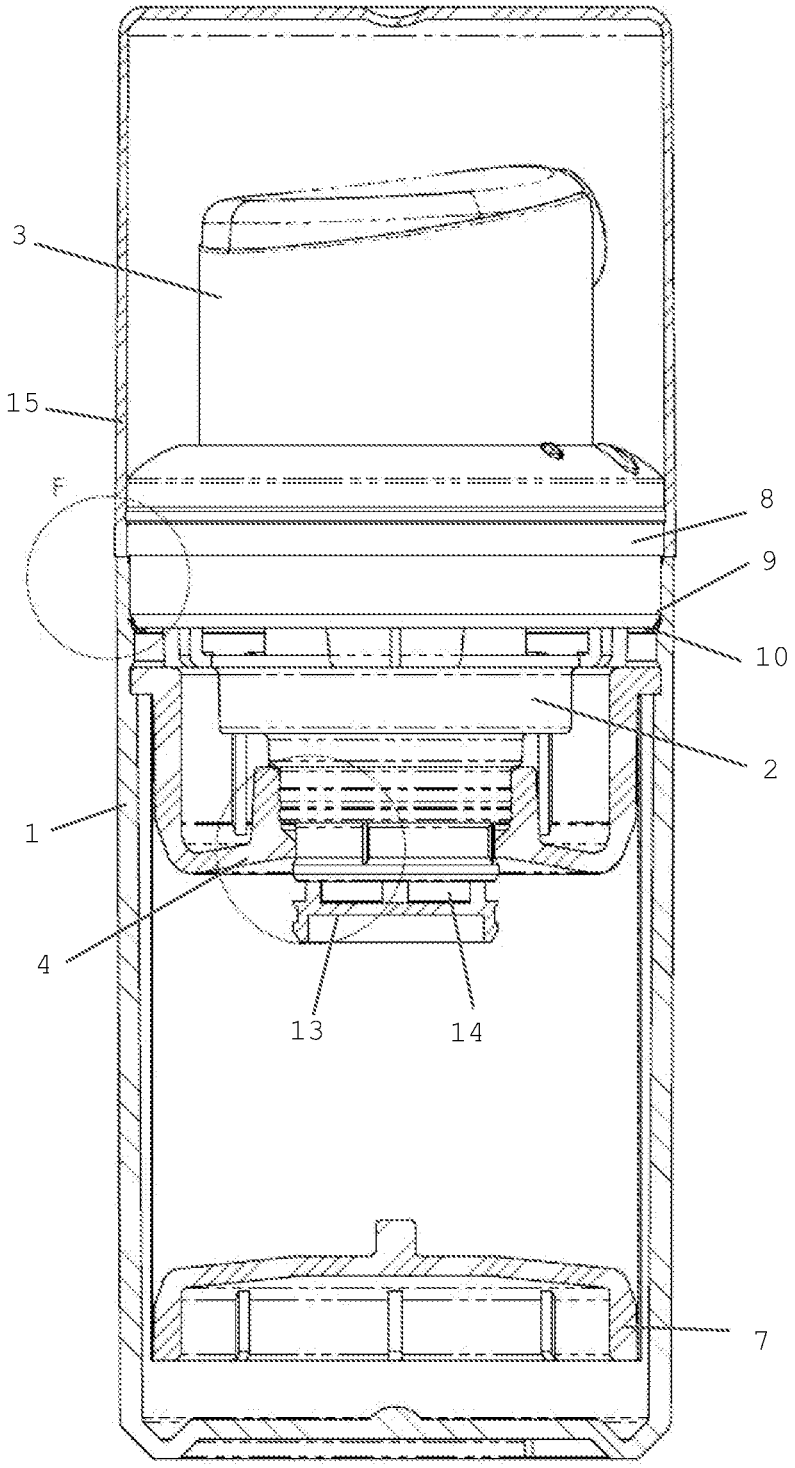
FIG. 6 shows a view in section of the pouch bottle from FIG. 1 after the locking device has been taken off.

The skirt (8) of the pump (2) is able to come into contact, by the edge (9) of its base, with the shoulder (10) formed on the internal face of the neck of the rigid bottle (1) when the pump is in the operating position shown in FIG. 6. In this position, the pump (2) bears against the collar (4).

In the storage position shown in FIG. 1, a ring (11) is interposed between the pump (2) and the neck of the bottle (1) in order to keep the edge (9) of the skirt (8) of the pump at a defined distance from the shoulder (10). This ring surrounds the base of the skirt (8) of the pump and prevents the latter from being positioned so that it can be activated.

Figure 2:
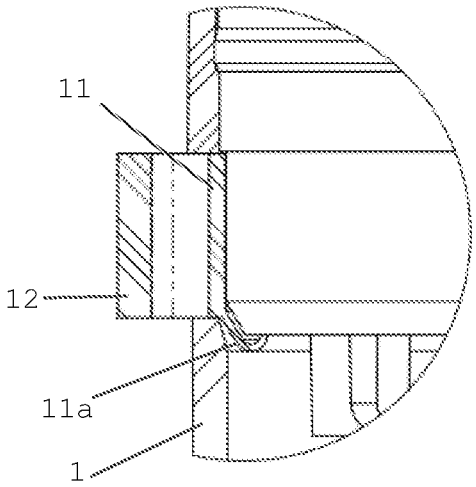
FIG. 2 shows a detail view in partial section of the part D in FIG. 1.
Figure 3:
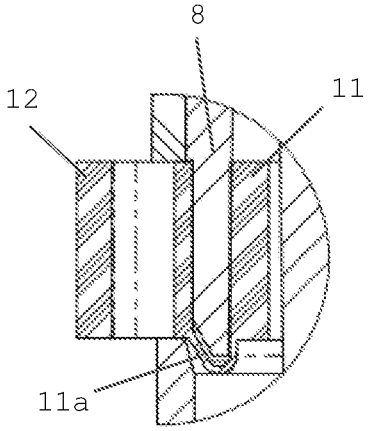
FIG. 3 shows a view in section of the device shown in FIG. 2.

This ring (11) is removable and can be taken off by pulling on a tab (12), shown in FIGS. 2 and 3, projecting from the surface of the bottle (1), making it possible to tear off the ring made of plastics material such as polyethylene. As shown in FIG. 3, the ring has a U-shaped section, the two legs of which press against the external and internal faces of the lower part of the skirt (8) of the pump. The base (11*a*) connecting the two legs of the ring (11) is frangible and can break when the user pulls on the tab (12).

Figure 4:
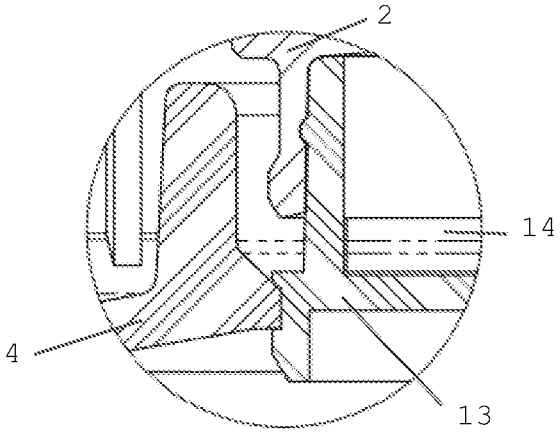
FIG. 4 shows a view in section of the detail of the open/close element of the pump.

The base of the pump (2) has an open/close element (13), the outer edge of which comes into sealing contact with the internal edge of the collar (4). These two parts are shaped so as to ensure good sealing and to prevent any passage of product from the pouch (5) to the pump (2) and any passage of gas from the outside through the pump to the pouch, as is shown more specifically in FIG. 4. Openings (14) are formed in the base of the pump in order to allow the product exiting the pouch (5) to pass through when the pusher (3) is actuated, the pump being in the operating position; but in the position shown in FIG. 1, in which the ring (11) is in place and the pump (2) is in the raised position, the passage circuit for the product from the pouch to the pump, passing through the openings (14), is closed by the contact between the internal edge of the collar (4) and the open/close element (13).

It can be seen that in this raised position of the pump (2), the open/close element (13) forms an insulating wall between the inside of the pouch (5) containing the product to be dispensed and the pump. Sealing is ensured by the contact between the outside edge of the open/close element (13) and the internal edge of the ring (4). The product contained in the pouch is thus perfectly isolated from the outside.

A cap (15) is provided above the pusher (3) in order to close the assembly.

Figure 5:
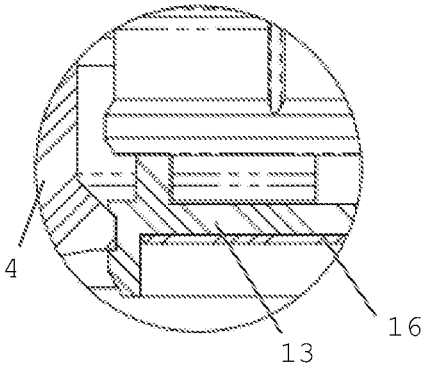
FIG. 5 shows a view in section of a variant of the open/close element from FIG. 4 to which a membrane seal has been added.

FIG. 5 shows the detail of a variant of the open/close element (13) in the closed position by sealed contact with the collar (4). The lower face of the open/close element (13) is covered with a membrane seal (16), preferably in the form of a film made of the same material as the pouch (5). Thus, any discontinuity of material between the pouch (5) and the open/close element (13) is avoided and the product contained in the pouch is in contact only with one material.

When the ring (11) is taken off by the user by tearing the tab (12), the pump (2) can be put into its final position by pushing it such that the edge (9) of the skirt (8) comes into contact with the shoulder (10) formed in the wall of the bottle (1) and such that the base of the pump can bear against the collar (4), in the position shown in FIG. 6.

Figure 7:
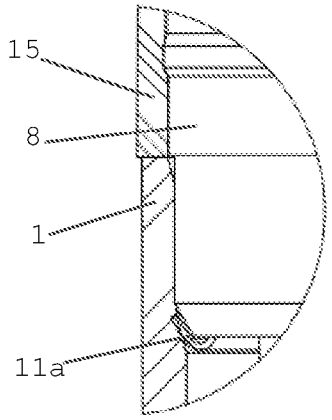
FIG. 7 shows a view in partial section of the detail in FIG. 2 after the locking device has been taken off.

As shown in FIG. 7, in this position, the lower edge of the protective cap (15) comes into contact with the upper edge of the neck of the bottle (1).

Figure 8:
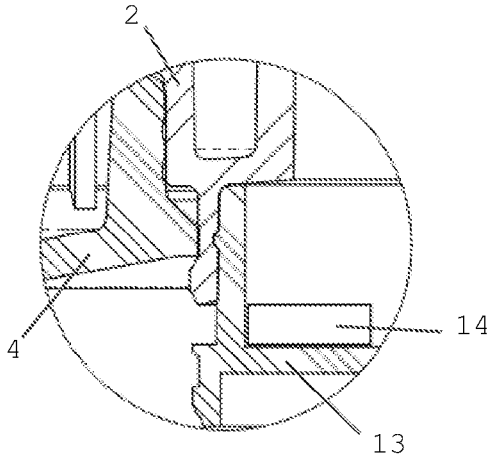
FIG. 8 shows a view in section of the open/close element from FIG. 4 after unlocking.

In this position, the open/close element (13) is spaced apart from the collar (4) supporting the pump and passes into the pouch (5), thereby freeing up the openings (14) for the product to pass from the pouch to the pump when the pusher (3) is actuated, as shown in more detail in FIG. 8.

Figure 9:
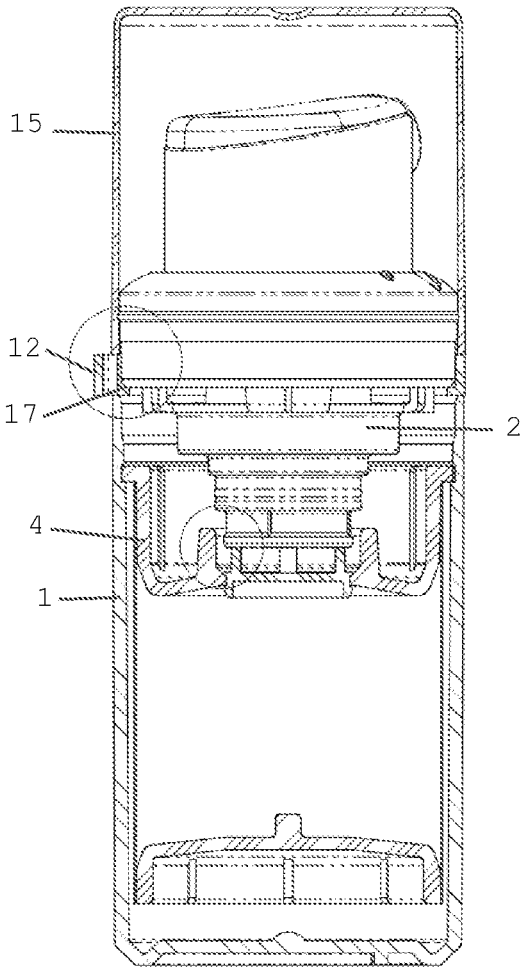
FIG. 9 shows a view in axial section of a variant of the pouch bottle in FIG. 1.
Figure 10:
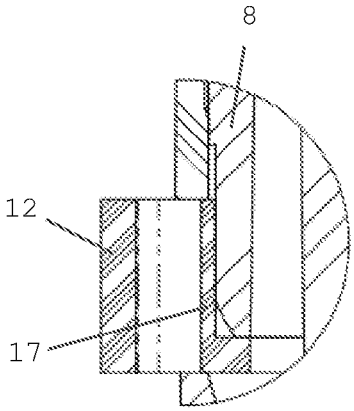
FIG. 10 shows a view in partial section of the detail of the fastener of the ring of the pouch bottle shown in FIG. 9.

In the variant embodiment of the invention that is shown in FIG. 9, and in more detail in FIG. 10, the removable element is formed by a single ring (17) having an initiator (12) for tearing it off. In the position shown in FIG. 9, the pump is raised by way of the ring (17) compared with its final operating position.

When this ring (17) has been entirely taken off by the user during first use, no obstacle remains under the base of the skirt (8) of the pump, which can be put into place, freeing up the open/close element and the passage from the pouch to the pump.

The invention claimed is:

1. Device for packaging and dispensing fluid products comprising:

having a manual pump fitted on a bottle containing the product to be dispensed, wherein said device has a removable element interposed between the pump and a neck of the bottle, and an open/close element which is secured to the pump and is able to close the passage circuit for the product to be dispensed between an inside of the bottle and the pump when the removable element is in place, wherein said open/close element is a rigid element secured to the pump and sliding towards the inside of the bottle when the removable element is removed and the pump is actioned.

2. Device according to claim 1, wherein the removable element is placed between a base of a skirt of the pump and a shoulder formed in the neck of the bottle intended to receive the pump.

3. Device according to claim 1, wherein the pump has the removable element placed on its periphery and the open/close element at its base.

4. Device according to claim 1, wherein the open/close element is fixed to a base of the pump and is in sealed contact with an internal face of the neck of the bottle or of a pouch containing the product, when the removable element is in place on the pump.

5. Device for packaging and dispensing fluid comprising:

a manual pump fitted on a bottle containing the product to be dispensed;

a support for supporting said manual pump, the support having a removable element interposed between the pump and a neck of the bottle; and an open/close element able to close the passage circuit for the product to be dispensed between an inside of the bottle and the pump when the removable element is in place, wherein the open/close element has at least one annular edge that engages with an internal edge of the support of the pump when the removable element is in place on the pump.

6. Device according to claim 3, wherein the lower face of the open/close element is covered with a part or a film that is impermeable to gases.

7. Device according to claim 6, wherein the film is a metal film placed on the lower face of the open/close element or inserted into a thickened portion of its lower face.

8. Device according to claim 1, wherein the removable element is formed by a double ring with a U-shaped section, legs of removable element surround external and internal faces of a skirt of the pump, and a base of which, connecting the two legs, is frangible.

9. Device according to claim 1, wherein the removable element is formed by a single ring surrounding an external face of a base of a skirt of the pump.

10. Device according to claim 1, wherein a base of the pump has openings released by the open/close element when the removable element is removed and the pump is actioned.

* * * * *